US005690126A

United States Patent [19]

Matsumura et al.

[11] Patent Number: 5,690,126

[45] Date of Patent: Nov. 25, 1997

[54] TOBACCO FILTER MATERIALS AND TOBACCO FILTER AS PRODUCED BY USING THE SAME

[75] Inventors: Hiroyuki Matsumura; Tohru Shibata, both of Himeji, Japan

[73] Assignee: Daicel Chemical Industries, Ltd., Osaka, Japan

[21] Appl. No.: 733,704

[22] Filed: Oct. 17, 1996

[30] Foreign Application Priority Data

Oct. 20, 1995 [JP] Japan ..... 7-297382

[51] Int. Cl.[6] ..... B29C 44/22

[52] U.S. Cl. ..... 131/343; 131/345; 131/331

[58] Field of Search ..... 131/345, 343, 131/331

[56] References Cited

U.S. PATENT DOCUMENTS 5,523,036 6/1996 Luke et al. ..... 264/45.3

FOREIGN PATENT DOCUMENTS 44-1944 1/1944 Japan .

52-38098 A 3/1977 Japan .

53-45468 4/1978 Japan .

8-113822 A 5/1996 Japan .

8-120517 A 5/1996 Japan .

8-126484 A 5/1996 Japan .

8-126485 A 5/1996 Japan .

*Primary Examiner*—Vincent Millin

*Assistant Examiner*—Robert Wieland

*Attorney, Agent, or Firm*—Cushman Darby & Cushman IP Group of Pillsbury Madison & Sutro, LLP

[57] ABSTRACT

A tobacco filter is obtained by shaping a sheet material having a web structure and comprising (1) cellulose acetate or other cellulose ester short staple, and (2) a binder fiber selected from polysaccharides or their derivatives and biodegradable polymers, and having a binding property with respect to the short staple into a rod-form. The fiber (2) includes (2a) an esterified cellulose fiber, (2b) a cellulose fiber coated with a cellulose ester, (2c) a fibrillated cellulose ester fiber having a BET specific surface area of 0.5 to 4.5 $m^2/g$, and (2d) a cellulose fiber at least a part of its surface has been water-solubilized. The sheet material may further comprise a wood pulp or other beaten pulps. The proportion of the fiber (1) relative to fiber (2) is such that the former/the latter equals about 30/70 to 98/2 (weight %)

18 Claims, No Drawings

TOBACCO FILTER MATERIALS AND TOBACCO FILTER AS PRODUCED BY USING THE SAME

FIELD OF THE INVENTION

This invention relates to a tobacco filter material in the form of a sheet which insures excellent wet disintegratability, eliminating properties of harmful components of tobacco smoke and satisfactory smoking qualities (aroma, taste and palatability of tobacco smoke), a tobacco filter as produced by using the tobacco filter material, and a tobacco provided with the tobacco filter.

BACKGROUND OF THE INVENTION

As a tobacco filter which removes harmful components (e.g. tars) from the tobacco smoke and insures a satisfactory smoking quality, a filter plug prepared by shaping a fiber bundle of cellulose acetate fibers with a plasticizer such as triacetin is in broad use. However, since the monofilaments in the bundle are partially fused to one another by the plasticizer, when such filter is discarded after smoking, it takes a long time for the filter plug to disintegrate itself in the environment, thus adding to the pollution problem.

Meanwhile, a tobacco smoke filter made of a creped paper manufactured from a wood pulp sheet and a tobacco filter made from a regenerated cellulose fiber bundle are also known. Compared with a filter plug comprising a cellulose acetate fiber bundle, these filters are slightly more wet-disintegratable and, thus, of somewhat lower pollution potential. However, in these filters, not only the aroma and palatability of tobacco smoke are sacrificed but also the efficiency of selective elimination of phenols which is essential to tobacco filters can hardly be expected.

It should be understood that a sheet material having a web structure comprising a cellulose ester short staple, where necessary together with other component such as a beaten pulp, is useful for enhancing the wet-disintegratability of the filter. A single use of a cellulose ester short staple, however, results in deteriorated interlacing of monofilaments with each other and hence such filter material is poor in sheet-formability. Further, when a material is processed into a sheet using the pulp or binder, the resultant sheet has a poor sheet strength. Therefore, when the sheet is processed with a creping roll or others previous to the wrapping up of the sheet, the sheet is damaged, and the cellulose ester short staple or other component is liable to be omitted from the sheet due to contact with an apparatus or in the wrapping up-working in a processing step for processing the sheet into a rod. Moreover, when the content of the cellulose ester short staple is increased for the purpose of improving the smoking quality, the sheet strength is sacrificed and there is necessity to decrease the rate of the shaping or processing by means of wrapping up, and hence the productivity of the filter is seriously limited.

The use of a naturally-occurring or synthetic resin binder would be expected for the purpose of enhancing the sheet strength and inhibiting omission of the short staple. By way of illustration, Japanese Patent Publication No. 1944/1969 (JP-B-44-1944) discloses a tobacco filter which is produced by adding a solution containing a hydrophobic polymer to paper by means of impregnation or spraying, and shaping the treated paper into a rod. However, since the constituent monofilaments or other component of the paper are adhered each other or coated due to the addition of the hydrophobic polymer, the wet-disintegratability of the filter is remarkably sacrificed, and since the cellulose ester is coated with the binder, the smoking quality might be deteriorated. Further, even when a water-soluble binder is used in lieu of the hydrophobic polymer, the yield of the water-soluble binder in the sheet as produced by wet webbing will be decreased, so that a special equipment is required for spreading.

Japanese Patent Application Laid-open No. 45468/1978 (JP-A-53-45468) discloses a sheet comprising a non-woven fibrous sheet containing 5 to 35% by weight of a cellulose ester fibril with a large surface area and 65 to 95% by weight of a cellulose ester short staple. The cellulose ester fibril is a fibrous cellulose substance having a surface area of not less than 5 $m^2/g$, a length of not longer than 1,000 μm and a diameter of 0.5 to 50 μm. Further, this literature also mentions that a wood pulp may be incorporated into a mixture of the cellulose ester fibril and the cellulose ester short staple. However, since the cellulose ester is difficult to be fibrillated, a special process is required to obtain the above-mentioned fibril having a large surface area, and, moreover, the disintegratability of this filter material is insufficient to alleviate the pollution problem.

Thus, according to a conventional tobacco filter, excellent smoking quality of tobacco, high elimination efficiency of harmful components of tobacco smoke, inhibition of omission of the fiber due to wrapping or other processing in the shaping process, high sheet strength and other characteristics as required for the filter material, and the wet-disintegratability can hardly be reconciled.

SUMMARY OF THE INVENTION

It is, therefore, an object of the present invention to provide a sheet material which insures compatibility of high wet-disintegratability and excellent filtrating property with respect to harmful components of tobacco, and satisfactory aroma, taste and palatability of tobacco, a tobacco filter and tobacco as produced by using this material.

It is another object of the invention to provide a sheet material which insures high wet-disintegratability, inhibits omission of the constituent fiber when processed, and provides high sheet strength, a tobacco filter and tobacco as produced with the use of the sheet material.

A further object of the invention is to provide a sheet material which is high in dry strength and yet disintegrates itself easily and rapidly under wet conditions in spite of comprising a cellulose ester short staple as a main component, a tobacco filter and tobacco as manufactured by using the sheet material.

It is a yet another object of the invention to provide a sheet material, a tobacco filter and a tobacco which are excellent in smoking quality and high in yield in webbing process, and has excellent disintegratability on contact with water.

A still further object of the invention is to provide a process which insures, in a second processing or shaping into a rod of a sheet material, smooth shaping of a sheet material into a rod while inhibiting omission of a cellulose ester short staple or other component from the sheet material.

The inventors of this invention did intensive research for accomplishing the above objects, and as a result, found that the use of a fiber having a binding property with respect to a cellulose ester short staple (e.g. an adequately fibrillated cellulosic fiber, a fiber which swells on contact with water or a fiber which is partially dissolved in water) in wet webbing insures effective utilization of such fiber as a binder for the cellulose ester short staple, and hence provides improvement of sheet strength and inhibits omission (falling) of the fiber without sacrificing the smoking quality and filtrating property of the product filter. The present invention has been accomplished based on the above findings.

Thus, the tobacco filter material in the form of a sheet of the present invention comprises (1) a cellulose ester short staple, and (2) a fiber selected from polysaccharides or derivatives thereof and biodegradable polymers, and having a binding property with respect to the short staple (hereinafter may briefly be referred to as "binder fiber"), and has a web structure. This sheet material may practically comprise the cellulose ester short staple (1) as a main component, and as the binder fiber (2), a cellulosic fiber containing a cellulose derivative may be used in many cases. At least a part of the surface of the binder fiber (2) may be composed of a cellulose ester. The binder fiber (2) includes, for example, (2a) an esterified cellulose fiber, (2b) a cellulose fiber coated with a cellulose ester, (2c) a fibrillated cellulose ester fiber having a BET specific surface area of 0.5 to 4.5 $m^2/g$, and (2d) a cellulose fiber where at least a part of its surface is water-solubilized (e.g. a cellulose fiber which has been carboxymethylated, methylated or hydroxyethylated). The cellulose ester includes an ester with an organic acid having 2 to 4 carbon atoms, such as a cellulose acetate with an average degree of substitution of about 1.5 to 3.

The sheet material may further comprise a beaten pulp such as a wood pulp.

The sheet material may be webbed or fabricated according to a conventional webbing technology, and by wet-webbing with the use of a slurry containing the binder fiber, a sheet can be obtained at a high rate without employing a special apparatus.

The tobacco filter of the invention is formed by shaping the sheet material by means of wrapping or the like. The tobacco of the invention is provided with the filter.

The term "sheet" as used in this specification means a two-dimensional paper-like artifact which can be taken up in a roll form.

DETAILED DESCRIPTION OF THE INVENTION

The sheet material comprises (1) a cellulose ester short staple, and (2) a specific fiber which has a binding property (a role as a binder) with respect to the short staple. The fiber may only have a physical binding property due to, for example, interlacing or entanglement of the components, chemical binding property or physico-chemical binding property by means of adhesion or affinity.

[Cellulose ester short staple]

The cellulose ester mentioned above includes, for example, cellulose acetate, cellulose propionate, cellulose butylate and other organic acid esters; cellulose nitrate, cellulose sulfate, cellulose phosphate and other inorganic acid esters; cellulose acetate propionate, cellulose acetate butylate, cellulose acetate phthalate, cellulose nitrate acetate and other mixed acid esters; and a polycaprolactone-grafted cellulose acetate and other cellulose ester derivatives. These cellulose esters may be employed alone or in combination.

The average polymerization degree (viscosity-average polymerization degree) of the cellulose ester is, usually, about 10 to 1,000 (e.g. about 50 to 1,000), preferably about 50 to 900 (e.g. about 100 to 800), and more preferably about 200 to 800.

The average substitution degree of the cellulose ester may be selected in the range of, for instance, about 1 to 3 (preferably about 1.5 to 3). The cellulose ester with an average substitution degree in the range of about 1 to 2.15, preferably about 1.1 to 2.0 is characterized in its excellent biodegradability.

The preferred cellulose ester includes organic acid esters (e.g. esters with organic acids each having 2 to 4 carbon atoms), such as cellulose acetate, cellulose propionate, cellulose butylate, cellulose acetate propionate, cellulose acetate butylate and the like, among which cellulose acetate can advantageously be employed. While the degree of acetylation (combined acetic acid) of cellulose acetate is generally within the rage of about 43 to 62%, those species with acetylation degrees in the range of about 30 to 50% are highly biodegradable. Therefore, the degree of acetylation of the cellulose acetate can be selected from the range of about 30 to 62%.

The cellulose ester short staple may be manufactured by, for example, cutting a fiber as produced according to a conventional spinning technology. The average fiber length of the cellulose ester short staple can be selected from a range not interfering with the sheet-formability by means of wet-webbing or other technology, and is, for instance about 1 to 20 mm, preferably about 1 to 10 mm (e.g. about 2 to 8 mm) and practically about 3 to 7 mm. When the fiber length of the short staple is excessively short, the production cost of the short staple is increased, and the sheet strength is deteriorated so that disadvantages such as rupture of the sheet in the wrapping step tend to occur. On the other hand, the use of a short staple having an excessively long fiber length detract from the dispersibility in water and the sheet-formability by means of wet-webbing, and tends to deteriorate the disintegratability in the environment.

The fineness of the cellulose ester short staple is, for instance, about 1 to 10 deniers, preferably about 2 to 8 deniers and more preferably about 3 to 6 deniers. When the fineness is too small, it is difficult to provide the short staple with a high efficiency according to a generally-employed technology, and a special technology is required for spinning. On the other hand, the use of a short staple having an excessively large fineness not only deteriorates the filtration efficiency and the sheet strength of the filter, but also results in a bulky sheet and hence difficulty in wrapping up of the sheet material, and tends to sacrifice the uniformity of the cross section of the filter.

The cellulose ester short staple may be whichever of a crimped fiber or a non-crimped fiber, but is preferably used in the non-crimped form for enhancing the webbing quality (web-formability), and disintegratability or dispersibility in wet conditions.

The cross-sectional configuration of the cellulose ester short staple is not particularly restricted but may for example be circular, elliptical, polygonal, modified configuration or hollow. For the purpose of decreasing the puff resistance (pressure drop) and enhancing the firmness (hardness) and filtrating properties of the filter, a cellulose ester short staple with a ratio R (D1/D2) of the diameter D1 of a circumscribed circle of the cross section of the finer relative to the diameter D2 of an inscribed circle of the cross section of not less than 2 (e.g. about 2.2 to 6), preferably about 2.3 to 5, and more preferably about 3 to 5 can advantageously be employed in the cellulose ester short staple having a polygonal or modified cross-section, as described in Japanese Patent Application No. 292149/1994. The fiber having a modified cross section includes those with cross sections of three-leaves, cross-shaped, R-, H-, I-, T-, U-, V-, Y-, X-configured or star-shaped. The preferable fiber having a modified cross section includes fibers having a cross section of X-, Y-, H-, I- or R-configured, in particular X-, Y-, H- or I configured. Among them, a fiber having a Y-configured cross section is particularly desirable.

[Binder fiber]

The binder fiber (2) includes a fiber which retains fibrous shape (morphology) at least partially in water, and have a binding property with respect to the above-mentioned short staple. Incidentally, whether a substance is "fibrous" in water or not can be judged or interpreted by a process comprising, in microscopic observation, arranging 10 or more substances in a predetermined field of vision, drawing a circumscribed circles respectively circumscribed with 5 substances having larger occupying areas among the substances, and determining whether the proportion of the area of the substance relative to the area of the circumscribed circle is 0.5 or less or not. The term "fibrous" means and includes a substance having the above-mentioned proportion of the areas of not greater than 0.5, inclusive of a linear or filamentous fiber. Such binder fiber may only be a fibrous substance which increases the sheet strength of the sheet by a factor of 10% or more as compared with a sheet having the same basis weight but as produced without the binder fiber, and decreases the binding power in the presence of water or due to biodegradation in the below-mentioned water-disintegratability test, where the above sheet is produced by adding 10 parts by weight of the binder fiber to 100 parts by weight of the total weight of the cellulose ester short staple and, where necessary, a pulp, and wet webbing the resultant mixture.

The binder fiber includes a fibrillated fiber which has been fibrillated to an adequate extent and a fiber swellable or partially soluble in contact with water. Further, the binder fiber may preferably be a fiber which does not deteriorates the smoking quality (aroma, taste and palatability of tobacco), and has a high safety as essential to tobacco filters which directly contact a mouth. Preferable binder fiber does not contain a monomer or oligomer component having volatility and causing offensive odor or malodor, and is any of biodegradable polymers, polysaccharides or their derivatives each having a safety in oral application. The biodegradable polymer includes, for example, aliphatic polyesters such as homo- or co-polymers of aliphatic hydroxycarboxylic acids inclusive of poly(lactic acid), poly(hydroxybutyric acid) and poly(glycolic acid), opening polymers of a lactone such as polycaprolactone, polyesters of an aliphatic diol having about 2 to 10 carbon atoms with an aliphatic dicarboxylic acid having about 2 to 12 carbon atoms. Examples of the polysaccharide or its derivative include naturally-occurring cellulose fibers, fibrous starches, regenerated cellulose fibers, fibers of chitin or chitosan, and so forth. These biodegradable polymers or polysaccharides or derivatives thereof can be used singly or in combination.

The use of the binder fiber made from the biodegradable polymer, polysaccharide or its derivative is effective in view of mitigation of the pollution burden. The fiber made from chitosan insures improved selective elimination properties for the phenol component and acidic component, and is useful for development of the disintegratability in weakly acidic conditions. Meanwhile, the sheet strength will be enhanced and omission (dropping off) of the short staple will be inhibited with an increasing content of the binder fiber made from the biodegradable polymer, but, inevitably, the proportion of the cellulose ester decreases so that the filtrating properties and smoking qualities with respect to tobacco smoke would sometimes adversely be affected.

On attaching importance to the filtrating properties or smoking qualities, it is effective to employ, as the binder fiber, cellulosic fibers comprising a cellulose derivative (e.g. a cellulose ester or a cellulose ether), among which a fiber at least a part of the surface thereof comprises a cellulose ester can advantageously be used. Such fiber includes, for instance, (2a) an esterified cellulose fiber, (2b) a cellulose fiber coated with a cellulose ester, and (2c) a fibrillated cellulose ester fiber having a definite BET specific surface area. The preferable cellulosic fiber also includes (2d) a cellulose fiber which has been water-solubilized at least partially. These fibers may also be employed singly or in combination.

The esterified cellulose fiber (2a) includes, for example, a fiber obtainable by esterification (e.g. acetylation by means of acetic acid or acetic anhydride) of a cellulose fiber in a non-solvent for the cellulose ester, and a cellulose fiber of which surface is esterified with an organic acid or its acid anhydride, typically speaking as described in detail in Japanese Patent Application Laid-open No. 113822/1996 (JP-A-8-113822). This esterified fiber comprises an esterified surface (surface layer) of the fiber, and a non-esterified portion in the internal (core) of the fiber.

The average substitution degree of such esterified fiber is not greater than 1.5 (e.g. about 0.01 to 1.5), preferably about 0.02 to 1.2, and more preferably about 0.05 to 0.5. The term "average substitution degree" as used in this specification means the average of degrees of substitution of the cellulose fiber as a whole which is esterified heterogeneously, and such meaning or concept is different from that of the term "substitution degree" for a cellulose ester fiber which is homogeneously reacted or substituted as manufactured by so-called solubilizing esterification.

The distribution of esterification of the esterified cellulose fiber can be affirmed or ascertained by, for example, dyeing the fiber with a direct dye (substantive color) or a disperse dye, and observing the section of the fiber. That is, an esterified portion or part will be dyed with the disperse dye and not dyed with the direct dye, and, to the contrary, a non-esterified and non-substituted portion of cellulose can be dyed with the direct dye and not dyed with the disperse dye.

The esterified fiber may be prepared by, for example, (i) a process which comprises a step of treating a cellulose fiber with an organic acid anhydride or organic acid halide in a poor solvent with respect to the cellulose ester, such as hexane or toluene, in the presence of a catalyst (e.g. pyridine and other bases, sodium acetate, potassium acetate and other alkali metal salts of organic carboxylic acids) (hereinafter referred to as "catalyst-method", (ii) a process which comprises a step of treating a cellulose fiber with an organic acid, and an organic acid anhydride or organic acid halide, or other technology. According to the process (ii), the treatment can be conducted in the presence of, or in the absence of, a catalyst. As the organic acid, there may be mentioned for example an organic acid corresponding to the cellulose ester, such as acetic acid, propionic acid, butyric acid and other aliphatic saturated carboxylic acid having about 2 to 4 carbon atoms. The organic acid anhydride or halide includes acid anhydrides of the organic acid, and halides thereof such as chlorides, bromides, iodides and so on. The amount of the organic acid anhydride or organic acid halide may be selected from a broad range of, for example, about 5 to 500 times by weight, and preferably about 20 to 20 times by weight relative to the material cellulose fiber.

The esterification may usually be carried out at a temperature of about 40° to 120° C. and preferably about 60° to 100° C., for about 10 minutes to 10 hours and preferably about 30 minutes to 3 hours.

The cellulose fiber coated with a cellulose ester (2b) is described in detail in, for example, Japanese Patent Application No. 254557/1994, and is a fiber as produced by coating a fibrous cellulose such as a wood pulp with a cellulose ester.

The coated cellulose coated with a cellulose ester on its surface may only be coated with a cellulose ester on at least a part of its surface, but a fiber of which surface is entirely coated with uniformity is desirable.

The coating amount of the cellulose ester in the coated cellulose fiber is, for example, not less than 0.1% by weight (e.g. about 0.1 to 50% by weight), preferably about 1 to 30% by weight, and more preferably about 5 to 15% by weight based on the total amount of the coated cellulose fiber. The coated cellulose fiber may practically be coated with the cellulose ester in a proportion of about 0.5 to 15% by weight and particularly about 1 to 12% by weight based on the total weight of the coated cellulose fiber.

In the esterified cellulose fiber (2a) and the coated cellulose fiber (2b), fibers which have been fibrillated are desirable. Such fibrillated fiber can be prepared by, for example, a process of esterifying or coating a fibrillated cellulose fiber which has been fibrillated by means of beating, inclusive of the below-mentioned beaten pulp, or a process of fibrillating an esterified cellulose fiber or coated cellulose fiber by means of beating, typically speaking.

The filter material comprising the esterified cellulose fiber (2a) or coated cellulose fiber (2b), since it comprises a cellulose ester on the surface of the fiber where attributes or relates to filtrating of tobacco smoke, insures excellent smoking quality of tobacco smoke and high filtration efficiency of harmful components in tobacco smoke, similarly to a cellulose ester short staple, and provides an excellent biodegradability equal to a filter made of a wood pulp or a regenerated cellulose fiber. Further, these fibers can be shaped into a sheet by means of wet-webbing without a plasticizer or the like so that they are excellent in disintegratability in wet conditions.

The fibrillated cellulose ester fiber having a definite BET (Brunauer-Emmett-Teller) specific surface area (2c) is described in Japanese Patent Application Laid-open No. 120517/1996 (JP-A-8-120517), and the fiber has a BET specific surface area of about 0.5 to 4.5 $m^2/g$, and preferably about 0.5 to 4 $m^2/g$ (e.g. about 1 to 3 $m^2/g$). The fibrillated cellulose ester fiber may practically have a BET specific surface area of about 0.7 to 3.5 $m^2/g$. The fibrillated cellulose ester fiber may usually have an amorphous fibrous configuration (shape) which is branched irregularly. This fibrillated cellulose ester is excellent in the wet-disintegratability despite its high strength, and hence insures compatibility between high strength and excellent disintegratability, as different from a non-fibrillated short staple or extremely fibrillated fibril. Further, since the fiber is composed of a cellulose ester, it insures excellent smoking quality (taste, aroma and palatability of tobacco smoke), and insures efficient elimination (removal) of harmful components of tobacco smoke.

The fibrillated cellulose ester fiber includes, for instance, (i) an amorphous fiber obtainable by extruding a cellulose ester solution from a nozzle into a coagulation agent (non-solvent or poor solvent), and allowing a shear force to act on the extrudate before coagulation, (ii) a fibrillated fiber, obtainable by immersing or dipping a fibrous cellulose ester obtained by means of a conventional spinning technology, to a mixture of a good solvent and poor solvent with respect to the cellulose ester, and allowing a shear force to act on the fiber on condition where the surface of the fiber is swelled to fibrillate the fiber, and (iii) a fibrillated fiber obtainable by beating a cellulose ester fiber. According to the process (i), the fibrillated cellulose ester fiber having the above-defined BET specific surface area can be obtained by allowing a sheering force to act on the fibrous cellulose ester solution (fibrous dope) extruded from a nozzle and allowing the extrudate to contact the precipitation agent (coagulation agent) to partially fibrillate and cut the extrudate before solidification of the cellulose ester.

The good solvent used for the preparation of the cellulose ester solution includes, for example, acetone, methyl ethyl ketone and other ketones; dioxane and other ethers; acetic acid and other carboxylic acids; methyl acetate and other esters; dichloromethane and other halogenated alkyls; mixtures of these organic solvents; mixtures of any of these organic solvents and water and/or an alcohol. The concentration of the cellulose ester in the cellulose ester solution is, usually, about 2 to 50% by weight, preferably about 5 to 40% by weight and more preferably about 10 to 25% by weight.

As the coagulation agent, there may be mentioned, for example, water; methanol and other alcohols; mixed solvents of water and any of the good solvents.

The constitutive cellulose ester of the fiber (2) of the above-mentioned fibers (2a), (2b) and (2c) may be composed of a similar cellulose ester (in particular a cellulose acetate, etc.) to that of the cellulose ester short staple (1).

The cellulose ester where at least a part of the surface thereof has been solubilized with respect to water (2d) includes, for instance, a fiber obtainable by treating a fibrous cellulose with e.g. monochloroacetic acid or its salt (a carboxymethylated cellulose fiber), a fiber as obtainable by treating a cellulose fiber with methyl chloride, dimethyl sulfate to give a methyl-etherified fiber (a methyl-etherified cellulose fiber), a fiber obtainable by treating a fibrous cellulose with ethyl chloride, diethyl sulfate to give an ethyl-etherified fiber (an ethyl etherized cellulose fiber), a fiber obtainable by treating a fibrous cellulose with ethylene oxide to give a hydroxyethylated fiber (a hydroxyethylated cellulose fiber), a fiber obtainable by treating a fibrous cellulose with propylene oxide to give a hydroxypropylated fiber (a hydroxypropylated cellulose fiber) and so on. This fiber is partially composed of a cellulose. Such cellulose fibers partially, e.g. in their surfaces, swellable or soluble with respect to water, so that it is useful for improving disintegratability on contact with water and hence is effective for mitigation of the pollution burden in the environment. The majority of the acid-type carboxymethyl cellulose fibers each having a free carboxyl group are insoluble in water. However, within the range retaining the fibrous morphology of the fiber, a part of the carboxyl group may be rendered to a water-soluble salt (e.g. a sodium salt and other alkali metal salts, an ammonium salt, an organic amine salt, etc.) to give a carboxymethyl cellulose fiber partially having a salt moiety, so that such fiber can be used in the same manner as above as a cellulose fiber at least a part of which surface has been solubilized with respect to water.

The fiber diameter and fiber length of the binder fiber can be selected from the ranges as far as the binder fiber can effectively be retained between the fibers in wet webbing process to contribute development of the paper strength, and the fiber may preferably have an aspect ratio of not less than 5. The fiber diameter of the binder fiber is about 0.01 to 100 μm (e.g. about 1 to 50 μm), and the fiber length may be about 0.1 mm to 5 cm and practically about 0.1 to 10 mm (e.g. about 0.5 to 4 mm).

Incidentally, the fiber length of the cellulose fiber in the esterified cellulose fiber (2a) and coated cellulose fiber (2b) may also be about 50 to 3,000 μm and preferably about 100 to 2,000 μm. The fineness of the fibrillated cellulose ester fiber (2c) may also be an average diameter of about 15 to 250 μm (e.g. about 20 to 200 μm), preferably about 20 to 200 μm and more preferably about 30 to 150 μm.

[Additional fibrous substance]

The sheet tobacco filter material of the present invention may be composed of only (1) the cellulose ester short staple and (2) the binder fiber, but it may further comprise (3) additional fibrous substance within the range not detracting from the smoking quality and filtrating property. Such additional fibrous substance includes, for instance, naturally-occurring cellulose fibers [e.g. wood fibers (a wood pulp of softwood or hard wood), seed fibers (linter and other cotton, bombax cotton, kapok, etc.), bast fibers (e.g. hemp, paper mulberry, Mitsumata, etc.), leaf fibers (e.g. Manila hemp, New Zealand hemp, etc.)] and synthetic fibers. These fibers may be pulped, and such pulp may be whichever of a beaten or unbeaten pulp. The preferable fiber includes a beaten pulp, among which a wood pulp (a wood pulp obtainable from a softwood or hardwood according to a conventional technology such as sulfite method or kraft method) is particularly desirable, typically speaking. The use of the wood pulp in an adequate amount in the range not interfering with the smoking quality insures decrease of the cost and enhances the filtration efficiency (elimination efficiency) of harmful components of tobacco.

The beating degree of the beaten pulp is, for example, a Shopper-Riegler freeness of about 10° to 90° SR (e.g. about 20° to 90° SR), preferably about 20° to 80° SR, more preferably about 25° to 75° SR and practically about 30° to 70° SR.

The fiber diameter and fiber length of the above-mentioned fibrous substance (in particular a wood pulp) are practically such that, for instance, the fiber diameter is about 0.01 to 100 μm and preferably about 0.1 to 50 μm, and the fiber length is about 50 to 5,000 μm and preferably about 100 to 4,000 μm.

[Proportions of each components]

In the sheet-like material comprising the cellulose ester short staple (1) and the binder fiber (2), the proportions of each components may be selected from the ranges not adversely affecting the wet-disintegratability or smoking quality, and the sheet material may practically comprise the cellulose ester short staple (1) as a main component. The proportion of the cellulose ester short staple (1) is, for example, about 30 to 98% by weight, preferably about 40 to 95% by weight and more preferably about 50 to 90% by weight based on the total weight of the sheet material. The relative ratio of the cellulose ester short staple (1) to the fiber (2) is, for example, such that the former/the latter equals about 30/70 to 98/2 (weight %), preferably about 40/60 to 95/5 (weight %), and more preferably about 50/50 to 90/10 (weight %). In the fiber where at least a part of the surface thereof comprises a cellulose ester, the cellulose ester in the surface is contributory to enhancement of the smoking quality and filtrating properties. Therefore, the amount of the fiber having the cellulose ester in its surface layer can be selected from a broad range. Further, when the fibrillated cellulose ester fiber is employed, the sheet material may essentially comprise 100% of the cellulose ester.

The proportion of the additional fibrous substance (3), in particular the beaten pulp is, for instance, about 5 to 100 parts by weight, preferably about 10 to 80 parts by weight, and more preferably about 20 to 70 parts by weight relative to 100 parts by weight of the total amount of the cellulose ester short staple (1) and the binder fiber (2).

[Structure and production process of the sheet material]

The sheet material of the invention has a nonwoven web structure in which constitutive filaments interlace each other. This material has a great dry strength and yet rapidly disintegrates itself in contact with moisture due to rain water or the like. The sheet material may also be prepared by a conventional dry webbing (dry fabricating) technology, such as by spraying the cellulose ester short staple, binder fiber or other component to a permeable support such as a net by means of an air flow. For the purpose of effective utilization of the binder fiber, it is preferable to form a sheet by wet webbing technology with the use of a slurry containing the cellulose ester short staple, binder fiber and, where necessary other component, dispersed in water.

The solid matter concentration of the slurry may optionally be selected from the range as far as paper webbing can be conducted, and is about 0.005 to 0.5% by weight and preferably about 0.01 to 0.3% by weight, for instance. The wet webbing (wet fabrication) can be carried out according to a conventional manner, such as a process comprising the steps of webbing with the use of a wet webbing machine (wet paper making machine) provided with a perforated panel or the like, dehydrating the resultant and drying the same.

The characteristics of the sheet material are not particularly limited as far as not deteriorating the filter characteristics (permeability, firmness, homogeneity of the cross section, etc.) or handling properties in wrapping step, and the material has, for example, a basis weight of about 15 to 45 g/m$^2$ and preferably about 20 to 40 g/m$^2$ (e.g. about 25 to 35 g/m$^2$), and a density of about 0.20 to 0.60 g/cm$^3$, and preferably about 0.25 to 0.50 g/cm$^3$ (e.g. about 0.30 to 0.45 g/cm$^3$). When the basis weight is excessively small, the preparation of the sheet is difficult and the sheet strength tends to be deteriorated, and on the other hand, the use of a sheet having an excessively great basis weight causes formation of crepes or embosses in a creping step or embossing step difficult, and tends to form heterogeneous gaps in the cross section of the filter and hence to cause sacrificed cross section. The use of a sheet having an excessively low density detracts from the sheet strength, and the use of a sheet having an extremely high density tends to make crepes or embosses formation in the creping step or embossing step difficult.

The sheet material may be shaped, as intact, into a rod to provide a tobacco filter, but the sheet material may advantageously be creped or embossed before the wrapping process for insuring a smooth and uniform passage of tobacco smoke through the filter plug (filter rod) without channeling. In particular, the sheet material of the invention is high in sheet strength and insures inhibition of omission of the short staple or other component, so that the material insures creping and/or embossing with high efficiency. Creping of the sheet material can be effected by guiding a sheet material over a pair of creping rollers (rolls) formed with a multiplicity of grooves running in the direction of advance of the sheet material to form wrinkles or creases, and to a lesser extent fissures along the path of travel. Embossing can be carried out by passing a sheet material over a set of rollers formed with graving-like or random relief pattern, or pressing a sheet material with a roller formed with a relief (concave-convex) pattern.

The pitch and depth of the grooves for creping and the pitch and depth of the embossing pattern can be selected from the range of about 0.3 to 5 mm (e.g. about 0.5 to 5 mm) for pitch and the range of about 0.1 to 2 mm (e.g. about 0.1 to 1 mm, preferably about 0.2 to 0.9 mm) for depth. The depth of the resultant crepes or embosses can liberally be selected by adjusting a clearance between the rollers even if the depth of the grooves or embossing patterns formed in the rollers is fixed.

In the creping or embossing process, the rollers may be warmed or heated, or may not be warmed or heated. For the purpose of obtaining a tobacco filter having an adequate permeability and firmness (rigidity) and homogeneous cross section, the sheet material may preferably be creped or embossed with the use of warmed or heated creping rollers and/or embossing rollers. The heating temperature of the rollers can be selected from a suitable range according to the species of the sheet material and desired characteristics of the filter, and is for example not lower than 70° C. (e.g. about 80° to 180° C.), and preferably not lower than 100° C. (e.g. about 110° to 160° C.).

According to such technique, crepes, winkles or embossing patterns can be formed in a sheet and hence the resultant sheet insures a high firmness in spite of its low pressure drop, and provides satisfactory cross section (homogeneity of the cross section). Further, moisturizing of a sheet in the creping or embossing process insures easy or ready formation of crepes, wrinkles or embossing patterns in a sheet, and hence insures mitigation of the pressure drop of the filter and enhancement of the firmness, and provides a homogeneous cross section of the filter. By creping or embossing as mentioned above, a filter having an adequate pressure drop (puff resistance), such as a pressure drop of about 200 to 600 mm WG (mm water gauge or mm $H_2O$) and preferably about 300 to 500 mm WG in a filter having a length of 10 cm and diameter of 7.8 mm can easily be obtained.

[Tobacco filter and tobacco]

The tobacco filter can be obtained by shaping the sheet material into a rod-form. Shaping of the sheet material into a rod may be effected by folding the sheet material, but may preferably be carried out by wrapping up the sheet material. Wrapping can be conducted according to a conventional technology, for example by charging the sheet material in a funnel and wrapping the charged material in wrapping paper into a rod (in particular, the material may practically be wrapped into a cylinder) with the use of a usual wrapping machine for paper filter. In the shaping step by means of e.g. wrapping, the bulk density of the product filter can be regulated or arranged according to desired characteristics of the filter. The rod-formed article is wrapped in wrapping paper, glued and cut to length to give a tobacco filter (filter plug or filter tip).

The tobacco according to the present invention is provided or equipped with the tobacco filter mentioned above. The tobacco filter may be arranged in any position or site of the tobacco, but in the tobacco as produced with wrapping paper into a rod form, it is practically arranged in a position with which a mouth of a smoker contacts, or a portion between the portion with which a mouth contacts and the cigarette (tobacco).

In the manufacture of filter plugs, where the gluing along edges of the wrapping paper formed into a cylinder and gluing between the cylindrical filter material and wrapping paper are necessary, a water-soluble adhesive or water-soluble hot-melt adhesive is preferably used as the glue in order that the wet-disintegratability will not be adversely affected.

The cellulose ester, sheet material, tobacco filter and tobacco mentioned above may comprise a variety of additives according to desired characteristics. Examples of such additive include finely divided powders of inorganic substances including kaolin, talc, diatomaceous earth, quartz, calcium carbonate, barium sulfate, titanium oxide and alumina; thermal stabilizers such as salts of alkali metals or alkaline earth metals; colorants; oils; yield improvers; sizing agents; adsorbents such as activated carbon. In particular, the environmental degradation of the filter etc. can effectively be increased by incorporating a biodegradation accelerator such as citric acid, tartaric acid, malic acid and the like and/or a photodegradation accelerator such as an anatase-form titanium oxide into the cellulose ester short staple. The anatase-form titanium oxide may also play a role as a whitening agent as described above.

Since the sheet material, tobacco filter and tobacco of the present invention are as produced by using a cellulose ester short staple and a specific binder fiber, they insure both high wet disintegratability, and high filtrating properties of harmful components of tobacco and excellent smoking qualities. Further, they not only are high in wet-disintegratability but also insure high strength of the sheet material without omission of fibers in the shaping or processing step. Moreover, in spite of comprising the cellulose ester short staple as a main component, they are high in dry strength and readily and easily disintegrate themselves in wet conditions. Furthermore, they are satisfactory in smoking qualities and high in yield in the webbing process, and have excellent disintegratability on contact with water. Therefore, they are contributory to mitigate the pollution burden of the environment.

According to the process of the invention where the sheet material is employed, omission of the cellulose ester short staple or the like from the sheet material in a secondary processing step such as creping or embossing or in shaping process into a rod can be inhibited to provide a high workability in shaping process.

The following examples are intended to describe this invention in further detail but should by no means be construed as defining the scope of the invention.

EXAMPLES

In the following examples and comparative examples, the data of the basis weight, Shopper-Riegler freeness, sheet density, tensile strength, water-disintegratability, smoking quality and degree of omission of fiber accompanied with wrapping were evaluated respectively according to the following methods.

Basis weight (g/m$^2$): Japanese Industrial Standards (JIS) P-8124

Shopper-Riegler freeness (°SR): JIS-P-8121

Sheet density (g/cm$^3$): The sheet density was calculated by the following equation:

$$\text{Sheet density}=[\text{Basis weight (g/m}^2)/\text{Sheet thickness (cm)}]/10000$$

wherein the sheet thickness was determined according to JIS-P-8118.

Tensile strength: JIS-P-8113

Water-disintegratability: About 0.2 g of a sample was put in 200 ml of water in a 300 ml-beaker (75 mm in diameter) and stirred with a magnetic stirrer to that the center height of the vortex would be equal to ¾ of the highest liquid level. After 10 minutes and 20 minutes, disintegration of the sample was observed, and water-disintegratability was evaluated according to the following evaluation criteria of 5 levels.

Evaluation criteria;

A: Completely disintegrated after 10 minutes

B: Not completely disintegrated and a non-disintegrated portion (mass or flocculus) remained after 10 minutes, but disintegrated entirely after 20 minutes C: Even after 20 minutes, a non-disintegrated portion remained, or a mass remained due to re-aggregation of others, although the shape of the sample collapsed D: Even after 20 minutes, not less than 50% of the sample remained without disintegration, or not less than 50% of the sample remained as a mass despite that the shape of the sample was collapsed E: Scarcely any sample disintegrated even after 20 minutes; original shape retained Smoking quality test: Each sample was fabricated into a filter plug and attached to a cigarette [a commercial cigarette "Hi-lite" (trade mark), Japan Tobacco Incorporation, from which the filter plug had been removed]. A panel of 5 habitual smokers was instructed to evaluate the smoking quality (aroma, taste and palatability) of the sample according to the following scoring criteria. The smoking quality score of the sample was indicated as an average value of the evaluation scores of the 5 subjects.

Organoleptic scoring criteria:

3: Not pungent (hot), with the good taste of tobacco smoke preserved

2: Not pungent (hot) but the taste of tobacco smoke sacrificed to some extent

1: Pungent or hot

Omission degree of fiber: The degree of omission the fiber was observed in the preparation of a tobacco filter by wrapping a creped sheet having a web structure into a cylindrical form, and the omission degree of the sample was evaluated according to the following criteria.

Evaluation criteria:

A: Little omission of the fiber

B: Large omission of the fiber

C: Extremely large omission of the fiber

The binder fibers were prepared according to the following preparation examples. As the Binder Fiber D, a commercially available carboxymethyl cellulose fiber (Nichirin Chemical Industries, Ltd., KICCOLATE LD-S1) was used. Since this carboxymethyl cellulose fiber was swelled on contact with water and partially dissolved in water, sodium bicarbonate was added to the slurry as in a concentration of about 0.03% by weight.

Preparation Example 1

(Preparation of Binder Fiber A)

By using a softwood sulfite pulp (α-cellulose content 92%) as a cellulose material, acetic anhydride as an acetylating agent, sulfuric acid as a catalyst, and acetic acid as a reaction solvent, a dope having a composition of cellulose diacetate/acetic acid/water=20/60/20 (by weight) was obtained by means of acetylation in a conventional manner and ageing (hydrolysis) the acetylated product. This dope was heated at 60° C. On the other hand, a 10 weight percent-aqueous solution of acetic acid was prepared and adjusted to a temperature of 20° C.

The coagulation agent prepared above was passed down a conduit (pipe), and simultaneously the dope was extruded from orifices of a nozzle, whereupon the dope was partially fibrillated by the shear force of a cutter and coagulated as it contacted the coagulation agent to provide a partially fibrillated cellulose acetate fiber.

The fiber thus obtained was centrifugally dehydrated and rinsed with warm water at 50° C. to remove the solvent. The apparent diameter of the fiber in wet condition as observed under the microscope was within the range of 50 to 150 μm. The fiber was then immersed in boiling water at 100° C. for 30 minutes, at the end of which time it was dehydrated. When this fiber was dried in a hot air current at 90° C., a soft, flocculent fiber mass was obtained. This constituent fiber had a fiber length of about 0.3 to 2 mm and a BET specific surface area of about 3.8 $m^2/g$.

Preparation Example 2

(Preparation of Binder Fiber B)

To 1,000 ml of water was dipped 10 g of a softwood sulfite pulp (α-cellulose content 94%) with a Shopper-Riegler freeness (beating degree) of 30° SR for 1 hour, and the immersed fiber was dehydrated by a factor of 5 times, and substituted with 100 ml of acetic acid. To the resultant were added 600 ml of acetic acid and 600 ml of acetic anhydride, and the mixture was subjected to reaction under a nitrogen gas flow using an oil-bath at 140° C. for 1 hour. The reaction product was thrown into 3,000 ml of water to decompose excess acetic anhydride, and the product was filtrated to separate, rinsed with water and dried to give a fibrous cellulose derivative (average fiber length: 4 mm, average fiber diameter: 20 μm) with an average substitution degree of 0.35. The fibrous cellulose derivative was dyed with a disperse dye (Disperse Yellow 3, manufactured by Aldrich Chemical Company Inc.) and cross section of the fiber was observed with the use of a microscope. As a result, only the outer region (surface layer) of the fiber was dyed with the dye, and hence it was confirmed that only the surface layer of the fiber was acetylated.

Preparation Example 3

(Preparation of Binder Fiber C)

To 400 ml of an acetone solution containing 3.0% by weight of a cellulose acetate (acetylation degree 55.5%, average substitution degree 2.45, residual calcium-to-residual sulfuric acid mol ratio of 1.2, average polymerization degree of 370) was added, with stirring, 10 g of a bleached softwood kraft pulp (Shopper-Riegler freeness (beating degree) 30° SR) which had been cracked with water and substituted with acetone. The resultant mixture was filtrated to remove the acetone solution. The obtained mixture was thrown into a water-bath imparted with a sufficient stirring force with the use of a mixer, and, thus, the cellulose acetate was coagulated or solidified. The resultant was air-dried to provide a coated fiber coated with a cellulose acetate on its surface. The coating amount of the cellulose acetate in the coated fiber was 2.1% by weight.

Examples 1 to 4 and Comparative Examples 1 and 2

A cellulose acetate short staple (substitution degree 2.45, Y-cross section, fineness 3 deniers, fiber length 4 mm), a binder fiber and a wood pulp were dispersed in water (slurry concentration 0.03% by weight) in proportions shown in Table 1, and using the resultant slurry, a web was fabricated by wet webbing technique using a round net-webbing machine. This web was dehydrated and dried to give sheet material shown in Table 1.

As the wood pulp, a beaten bleached softwood kraft pulp with a Shopper-Riegler freeness of 40° SR was employed.

The tensile strength in the longitudinal direction (webbing direction or machine direction) and water-disintegratability of the sheet materials obtained above were evaluated. Further, the sheet materials thus obtained were creped with the use of a creping roller (groove pitch 1 mm, groove depth 0.8 mm) with a surface temperature of 130° C., and the creped sheets were wrapped into a cylindrical form to give tobacco filters each with a circumferential length of about 24.5 mm. The smoking quality of the tobacco filters were evaluated, and the results are set forth in Table 1.

TABLE 1

| | Short staple | Binder fiber Species | Binder fiber Amount | Pulp | Basis weight ($g/m^2$) | Tensile strength (kg/15 mm) | Water-disintegratability | Smoking quality | Omission of fiber |
|---|---|---|---|---|---|---|---|---|---|
| Comp. Ex. 1 | 60 | — | — | 40 | 30 | 1.20 | A | 2.6 | B |
| Example 1 | 50 | A | 10 | 40 | 29 | 1.50 | B | 2.6 | A |
| Comp. Ex. 2 | 70 | — | — | 30 | 30 | 0.85 | A | 2.8 | C |
| Example 2 | 50 | B | 20 | 30 | 30 | 1.30 | A | 2.8 | A |
| Example 3 | 50 | C | 20 | 30 | 31 | 1.30 | B | 2.6 | A |
| Example 4 | 60 | D | 10 | 30 | 29 | 1.55 | A | 2.4 | A |

In comparison between Comparative Example 1 and Examples 1 and 4 in the table, the sheets according to Examples 1 and 4 had improved sheet strength as compared with the sheet according to Comparative Example 1, and hence they insured wrapping process at high rate (high speed), provided excellent water-disintegratability and satisfactory smoking quality, and showed remarkably decreased omission of fiber in creping step with the use of a creping roller and wrapping step. The sheet according to Comparative Example 1 had a sheet strength insuring the wrapping up at a comparatively high wrapping rate (e.g. at a rate of about 200 m/min.), but it showed great omission of the fiber particularly in creping step with a creping roller and hence provided extremely deteriorated workability.

As apparent from the comparison between Examples 2 to 4 and Comparative Example 2, the sheets according to Examples were high in sheet strength and provided the wrapping at a comparatively high rate, and insured significantly decreased omission of the fiber, when compared with the sheet according to Comparative Example 2. Further, the sheets had excellent water-disintegratability and satisfactory smoking quality. Incidentally, the sheet according to Comparative Example 2 as produced by using a large amount of the cellulose acetate short staple provided sacrificed sheet strength and extremely large omission of the fiber, and, in addition, the sheet was ruptured due to the wrapping up, typically speaking.

Comparative Example 3

A bundle of cellulose acetate short staple (substitution degree 2.45, short staple fineness 3 deniers) was shaped with the use of triacetin to provide a filter. The water-disintegratability and smoking quality of this filter were evaluated, and the filter showed a smoking quality score of 2.8, but the water-disintegratability of the filter was level "E".

Comparative Example 4

A sheet was manufactured in the same manner as Example 1 except for using the bleached softwood kraft pulp with a beating degree of 45° SR used in Example 1 and no other. The water-disintegratability of the obtained sheet was evaluated, and as a result, the water-disintegratability of level "B". Then, using this sheet, a tobacco filter was provided in the same manner as the examples, and the smoking quality of the product tobacco filter was evaluated. The smoking quality of the filter was deteriorated, as a score of 1.0.

What is claimed is:

1. A tobacco filter material in the form of a sheet having a web structure, which comprises (1) a cellulose ester short staple and (2) a binder fiber selected from the group consisting of polysaccharides or derivatives thereof and biodegradable polymers, and having a binding property with respect to said short staple.

2. A tobacco filter material as claimed in claim 1, wherein said material comprises said cellulose ester short staple (1) as a main component.

3. A tobacco filter material as claimed in claim 1, wherein the proportion of the cellulose ester short staple is 30 to 98% by weight based on the total weight of the sheet material.

4. A tobacco filter material as claimed in claim 1, wherein said binder fiber (2) is a cellulosic fiber comprising a cellulose ester derivative.

5. A tobacco filter material as claimed in claim 1, wherein at least a part of the surface of said binder fiber (2) comprises a cellulose ester.

6. A tobacco filter material as claimed in claim 1, wherein said binder fiber (2) is at least one member selected from the group consisting of:

(2a) an esterified cellulose fiber, (2b) a cellulose fiber coated with a cellulose ester, (2c) a fibrillated cellulose ester fiber having a BET specific surface area of 0.5 to 4.5 $m^2/g$, and (2d) a cellulose fiber where at least a part of its surface has been solubilized with respect to water.

7. A tobacco filter material as claimed in claims 1, wherein said binder fiber (2) is (2d) a cellulose fiber where at least a part of its surface has been solubilized with respect to water.

8. A tobacco filter material as claimed in claim 7, wherein the cellulose fiber has been subjected to at least one solubilizing treatment selected from the group consisting of carboxymethylation, methyl-etherification, ethyl-etherification, hydroxyethylation and hydroxypropylation.

9. A tobacco filter material as claimed in claim 1, wherein said binder fiber (2) has a fiber diameter of 0.01 to 100 μm and a fiber length of 0.1 mm to 5 cm.

10. A tobacco filter material as claimed in claim 1, wherein said material further comprises a beaten pulp.

11. A tobacco filter material as claimed in claim 10, wherein the proportion of the beaten pulp is 5 to 100 parts by weight relative to 100 parts by weight of the total weight of the cellulose ester short staple (1) and the binder fiber (2).

12. A tobacco filter material as claimed in claim 10, wherein said beaten pulp is a wood pulp.

13. A tobacco filter material as claimed in claim 1, wherein the proportion of said cellulose ester short staple (1) relative to said binder fiber (2) is 3% to 98% (weight %).

14. A tobacco filter material as claimed in claim 1, wherein said cellulose ester is an ester with an organic acid having 2 to 4 carbon atoms.

15. A tobacco filter material as claimed in claim 1, wherein said cellulose ester is a cellulose acetate having an average substitution degree of 1.5 to 3.

16. A tobacco filter which comprises a tobacco filter material in the form of a sheet having a web structure as processed into a rod, which material comprising: (1) a cellulose ester short staple and (2) a binder fiber selected from the group consisting of polysaccharides or derivatives thereof and biodegradable polymers, and having a bonding property with respect to said short staple.

17. A process for producing a tobacco filter which process comprises the step of processing a sheet tobacco filter material having a web structure into a rod, which material comprising (1) a cellulose ester short staple and (2) a binder fiber selected from the group consisting of polysaccharides or derivatives thereof and biodegradable polymers, and having a bonding property with respect to said short staple.

18. A tobacco which is provided with the tobacco filter of claim 16.

* * * * *